US008443778B2

(12) United States Patent
Dalke

(10) Patent No.: US 8,443,778 B2
(45) Date of Patent: May 21, 2013

(54) DUAL CRANKSHAFT INTERNAL COMBUSTION ENGINE

(76) Inventor: Arthur E. Dalke, Tulsa, OK (US)

( * ) Notice: Subject to any disclaimer, the term of this patent is extended or adjusted under 35 U.S.C. 154(b) by 154 days.

(21) Appl. No.: 12/851,188

(22) Filed: Aug. 5, 2010

(65) Prior Publication Data

US 2011/0030651 A1 Feb. 10, 2011

Related U.S. Application Data

(60) Provisional application No. 61/232,165, filed on Aug. 7, 2009.

(51) Int. Cl.
*F02B 75/32* (2006.01)

(52) U.S. Cl.
USPC ..... 123/197.4; 123/197.1; 123/197.3; 123/53.1; 123/53.2

(58) Field of Classification Search
USPC ..... 123/53.1, 53.2, 197.4, 197.1, 197.3
See application file for complete search history.

(56) References Cited

U.S. PATENT DOCUMENTS

| | | | | |
|---|---|---|---|---|
| 1,585,796 | A | 5/1926 | Appleton | |
| 2,392,921 | A | 1/1946 | Holman | |
| 3,315,465 | A | 4/1967 | Wallis | |
| 3,485,221 | A * | 12/1969 | Feeback | 123/51 AA |
| 3,680,396 | A | 8/1972 | Healy | |
| 4,614,169 | A * | 9/1986 | Figliuzzi | 123/53.2 |
| 4,690,113 | A * | 9/1987 | Deland | 123/197.4 |
| 4,898,041 | A | 2/1990 | Islas | |
| 5,211,065 | A * | 5/1993 | Mandella | 74/51 |
| 5,535,715 | A * | 7/1996 | Mouton | 123/197.1 |
| 5,595,147 | A | 1/1997 | Feuling | |
| 5,836,273 | A | 11/1998 | Hair | |
| 7,584,724 | B2 * | 9/2009 | Berger | 123/48 R |
| 2007/0079788 | A1 | 4/2007 | Betzmeir | |

FOREIGN PATENT DOCUMENTS

| | | |
|---|---|---|
| KR | 20060109499 | 10/2006 |

* cited by examiner

*Primary Examiner* — Noah Kamen
*Assistant Examiner* — Grant Moubry
(74) *Attorney, Agent, or Firm* — Head Johnson & Kachigian, PC

(57) ABSTRACT

A dual crankshaft internal combustion engine having two rotating offset crankshafts respectively attached to connecting rods. Each of the connecting rods, in turn, are pivotally attached to piston rods, which are located an equidistance between the crankshafts. The piston rods are attached to a piston reciprocally disposed in a cylinder. The crankshafts are aligned in parallel and are geared together, either directly or indirectly, thus causing the crankshafts to rotate in the same or opposite directions, depending upon the linkage gear configuration. The dual crankshaft internal combustion engine utilizes leverage from the wedge-effect of the offset crankshafts to provide increased torque, power duration and fuel efficiency.

20 Claims, 5 Drawing Sheets

DUAL CRANKSHAFT INTERNAL COMBUSTION ENGINE

CROSS-REFERENCE TO RELATED APPLICATIONS

This application claims priority to U.S. Provisional Application Ser. No. 61/232,165, filed Aug. 7, 2009, which is incorporated herein by reference.

BACKGROUND OF THE INVENTION

1. Field of the Invention

This invention relates generally to a dual crankshaft internal combustion engine, and more particularly to a dual crankshaft internal combustion engine utilizing two rotating, offset crankshafts that provide increased rotational torque and/or power duration in an internal combustion engine.

2. Description of the Related Art

In conventional internal combustion engines, each piston drives a single crankshaft through a single connecting rod extending between a wrist pin centrally located in the piston and a crankshaft pin. This arrangement is simple, light weight and has been brought to a high degree of development. This arrangement, however, has problems with balance, noise and sidewall thrust on the piston resulting in undesirable friction. Consumers continue to demand smoother, more efficient, quieter engines. Automobile manufacturers have implemented engine balancing aids, primarily in the form of rotating balance shafts. Balance shafts are devices that improve balance but create durability problems, increased cost, complexity and weight as well as reduced engine efficiency, however, off-center piston forces, noise and side thrust problems remain.

It is therefore desirable to provide a dual crankshaft internal combustion engine that increases an engine's rotational torque and power duration.

It is further desirable to provide a dual crankshaft internal combustion engine that provides improved fuel efficiency.

It is still further desirable to provide a dual crankshaft internal combustion engine utilizing two crankshafts being vertically offset from the piston, which results in an increased power stroke and torque in an engine.

It is still further desirable to provide a dual crankshaft internal combustion engine that increases the power stroke to two-hundred and fifteen degrees) (215°) of the corresponding crankshaft rotation from one-hundred and eighty degrees) (180°) of the crankshaft rotation in a conventional engine.

It is still further desirable to provide a dual crankshaft internal combustion engine where the angle at which the connecting rods are attached to the crankshafts in the dual crankshaft internal combustion engine serves to develop increased rotational torque.

SUMMARY OF THE INVENTION

In general, in a first aspect, the invention relates to a dual crankshaft internal combustion engine having a first crankshaft and a second crankshaft in a spaced relation and having parallel rotary axes. The first crankshaft and the second crankshaft each have a spur gear for rotation about the rotary axis of the crankshaft. The spur gears of the first crankshaft and the second crankshaft have the same diameter and the same number of teeth, causing the first crankshaft and the second crankshaft to rotate at the same speed and in the same or opposite directions. The dual crankshaft internal combustion engine also has at least one linkage gear disposed intermediate of the first crankshaft and the second crankshaft. The linkage gear is engaged with the spur gear of the first crankshaft and the spur gear of the second crankshaft. The dual crankshaft internal combustion engine also includes at least one cylinder having a head at an upper end and a crank case at a lower end and at least one piston within the cylinder. The piston cyclically reciprocates within the cylinder between a top dead center position and a bottom dead center position. A first connecting rod and a second connecting rod are pivotally attached to a first piston rod and a second piston rod via a connecting rod pin, and the first piston rod and the second piston rod are connected to the piston via a piston pin. Further, the first piston rod and the second piston rod are located an equidistance between the first crankshaft and the second crankshaft.

The first crankshaft may rotationally lag the second crankshaft, or vice versa where the second crankshaft rotationally lags the first crankshaft, until both the first crankshaft and the second crankshaft rotate past the top dead center position. The rotational lag of the first crankshaft and the second crankshaft may be between approximately 0 degrees and approximately 20 degrees, such as approximately 15 degrees.

The linkage gear of the dual crankshaft internal combustion engine may be an output shaft and a power shaft intermediate of the first crankshaft and the second crankshaft for a power transmission. The output shaft and the power shaft may be geared together and geared with the first crankshaft and the second crankshaft, such that the rotational motion of the first crankshaft and the second crankshaft is transferred to the output shaft and the power shaft. The output shaft and the power shaft may be staggered, and the first crankshaft and the second crankshaft may counter-rotate in opposite directions. Furthermore, a power stroke of the dual crankshaft internal combustion engine can be increased from 180 degrees to approximately 215 degrees for increased power stroke and rotational torque output.

In general, in a second aspect, the invention relates to a dual crankshaft internal combustion engine having a first crankshaft and a second crankshaft in a spaced relation and having parallel rotary axes. The first crankshaft and the second crankshaft each have a spur gear for rotation about the rotary axis of the crankshaft, and the spur gear of the first crankshaft and the second crankshaft have an equal diameter and an equal number of teeth, causing the first crankshaft and the second crankshaft to rotate at equal speeds and in a same direction. The dual crankshaft internal combustion engine also includes an odd number of linkage gears disposed intermediate of the first crankshaft and the second crankshaft. The linkage gears are engaged with the spur gear of the first crankshaft and the spur gear of the second crankshaft. Further, the dual crankshaft internal combustion engine includes at least one cylinder having a head at an upper end and a crank case at a lower end, and at least one piston within the cylinder. The piston cyclically reciprocates within the cylinder between a top dead center position and a bottom dead center position. The first crankshaft and the second crankshaft are vertically offset from the piston. In addition, the dual crankshaft internal combustion engine includes a first connecting rod and a second connecting rod pivotally attached to a piston rod via a connecting rod pin. The piston rod is connected to the piston via a piston pin, and the piston rod is located an equidistance between the first crankshaft and the second crankshaft.

The spur gear of the first crankshaft may rotate in a clockwise direction. Moreover, an intake valve of the dual crankshaft internal combustion engine may be closed at approximately 110 degrees to maintain a 10-1 compression ratio resulting in an at least 15-1 expansion ratio. In addition, the first crankshaft may rotationally lag the second crankshaft or the second crankshaft rotationally lag the first crankshaft by approximately 0 degrees to approximately 20 degrees until both the first crankshaft and the second crankshaft rotate past the top dead center position.

In general, in a third aspect, the invention relates to a dual crankshaft internal combustion engine comprising a first crankshaft and a second crankshaft in a spaced relation and having parallel rotary axes. The first crankshaft and the second crankshaft each have a spur gear for rotation about the rotary axis of the crankshaft, and the spur gears of the first crankshaft and the second crankshaft have an equal diameter and an equal number of teeth, causing the first crankshaft and the second crankshaft to rotate at an equal speed and in opposite directions. Further, the dual crankshaft internal combustion engine includes an even number of linkage gears disposed intermediate of the first crankshaft and the second crankshaft, with the linkage gears engaged with the spur gear of the first crankshaft and the spur gear of the second crankshaft. The linkage gears comprise an output shaft and a power shaft intermediate of the first crankshaft and the second crankshaft. The output shaft and the power shaft are geared together and geared with the first crankshaft and the second crankshaft, such that the rotational motion of the first crankshaft and the second crankshaft is transferred to the output shaft and the power shaft. Further, the dual crankshaft internal combustion engine includes at least one cylinder having a head at an upper end and a crank case at a lower end and at least one piston within the cylinder. The piston cyclically reciprocates within the cylinder between a top dead center position and a bottom dead center position. The first crankshaft and the second crankshaft are vertically offset from the piston. Additionally, a first connecting rod and a second connecting rod are pivotally attached to a piston rod via a connecting rod pin. The piston rod is connected to the piston via a piston pin. The piston rod is located an equidistance between the first crankshaft and the second crankshaft. The dual crankshaft internal combustion engine has a power stroke of approximately 215 degrees.

The output shaft and the power shaft may be staggered, and the spur gear of the first crankshaft can rotate in a counterclockwise direction. An intake valve of the dual crankshaft internal combustion engine can be closed at approximately 140 degrees to maintain a 10-1 compression ratio resulting in an at least 15-1 expansion ratio.

Moreover, the dual crankshaft internal combustion engine may be a two-stroke, four-stroke, V-6, V-8, diesel, inline or opposed-piston internal combustion engine.

Figure 1:
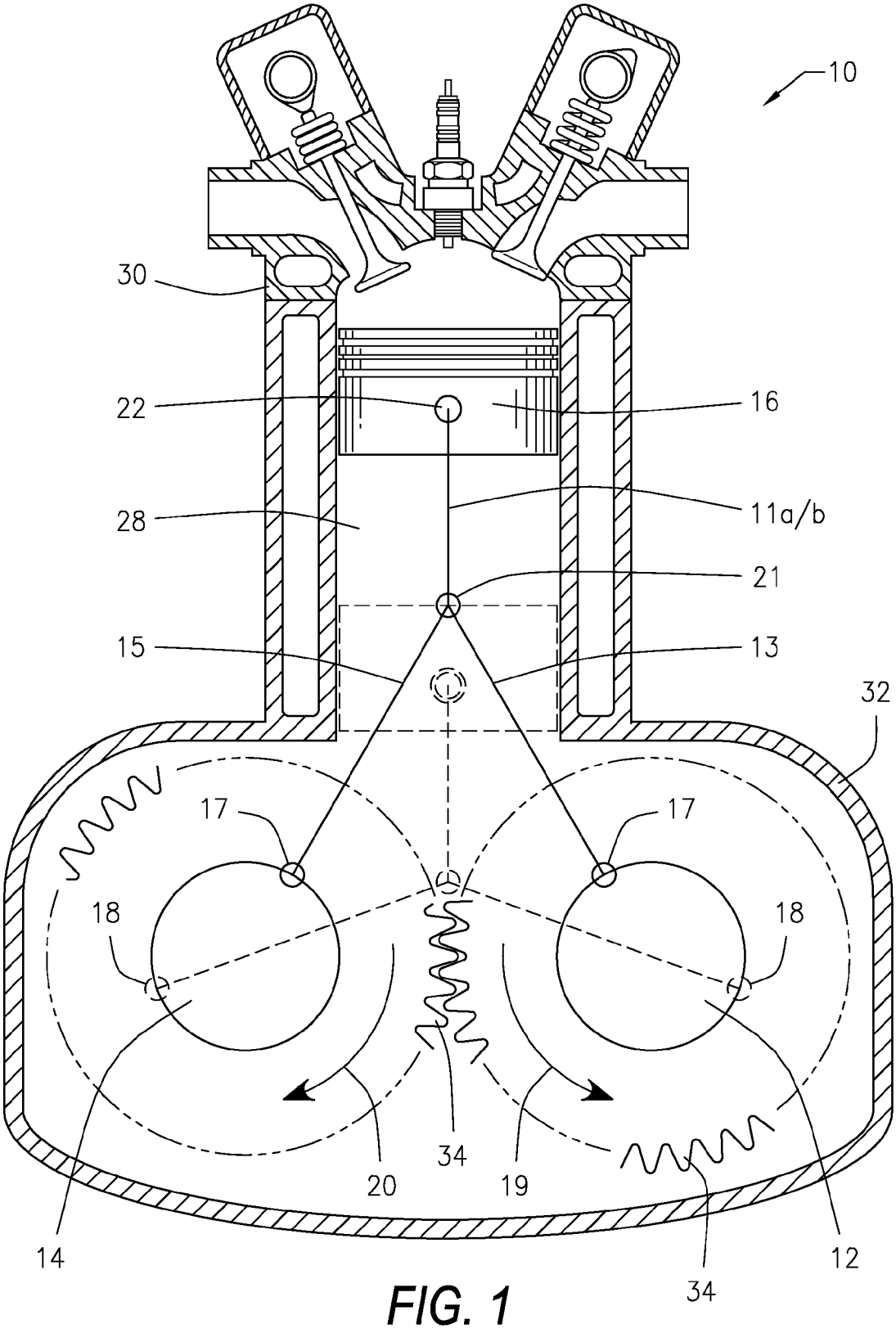
FIG. 1 is a schematic view of an example of an illustrative embodiment of the dual crankshaft internal combustion engine disclosed herein.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, the invention relates to a dual crankshaft internal combustion engine utilizing two rotating, offset crankshafts, which are secured to connecting rods, which in turn are rotatably connected to piston rods in an internal combustion engine. The dual crankshaft internal combustion engine increases an engine's rotational torque by at least fifty percent (50%). Further, when the dual crankshaft internal combustion engine is configured to utilize counter-rotating crankshafts, the power duration is increased by approximately thirty-three percent (33%). The dual crankshaft internal combustion engine comprises two (2) parallel crankshafts rotatably attached to two (2) connecting rods. The connecting rods are pivotally attached to piston rods via a connecting rod pin, and the piston rods are located an equidistance between the crankshafts. The connecting rods form a wedge to provide leverage for increased torque and power stroke in the engine. The piston rods are pivotally attached to the bottom center of a piston located in a cylinder. The crankshafts are geared together, thus making them rotate either in opposite directions or in the same direction, depending upon the particular linkage gear configuration of the dual crankshaft internal combustion engine. If an opposite direction rotation is desired, the number of linkage gears should be an even number, whereas if a same direction rotation is utilized, an odd number of linkage gears should be utilized.

Referring to the figures of the drawings, wherein like numerals of reference designate like elements throughout the several views, and initially to FIGS. 1 through 6, a dual crankshaft internal combustion engine 10 having crankshafts 12 and 14, with 14 being a mirror image of 12, respectively rotatably connected to connecting rods 13 and 15. The crankshafts 12 and 14 are in a spaced relation and have parallel rotary axes. Connecting rods 13 and 15 are pivotally attached to piston rods 11*a* and 11*b* via a connecting rod pin 21, respectively. The piston rods 11*a* and 11*b* are connected to the piston 16 using a piston pin 22. Piston rods 11*a* and 11*b* are located an equidistance between crankshafts 12 and 14. Alternatively, the dual crankshaft internal combustion engine 10 may utilize a single piston rod having a substantially Y-shape.

The engine 10 has a cylinder 28 having a head 30 at an upper end and a crank case 32 at a lower end. The piston 16 cyclically reciprocates within the cylinder 16 between a top dead center position 17, shown by solid lines in FIG. 1, and a bottom dead center position 18, shown by dashed lines in FIG. 1. Crankshafts 12 and 14 are geared together, either directly or indirectly by spur gears 34 causing crankshafts 12 and 14 to rotate. The gears 34 are of the same diameter with the same number of teeth, causing the crankshafts 12 and 14 to rotate at the same speed and in the same or opposite directions, as discussed below depending upon the configuration of the engine 10. As exemplified in FIG. 1, the crankshafts 12 and 14 may be directly geared together causing the crankshafts to counter-rotate as shown by directional arrows 19 (counterclockwise rotation) and 20 (clockwise rotation). As exemplified, the right crankshaft 12 rotates in a counterclockwise direction.

Figure 2:
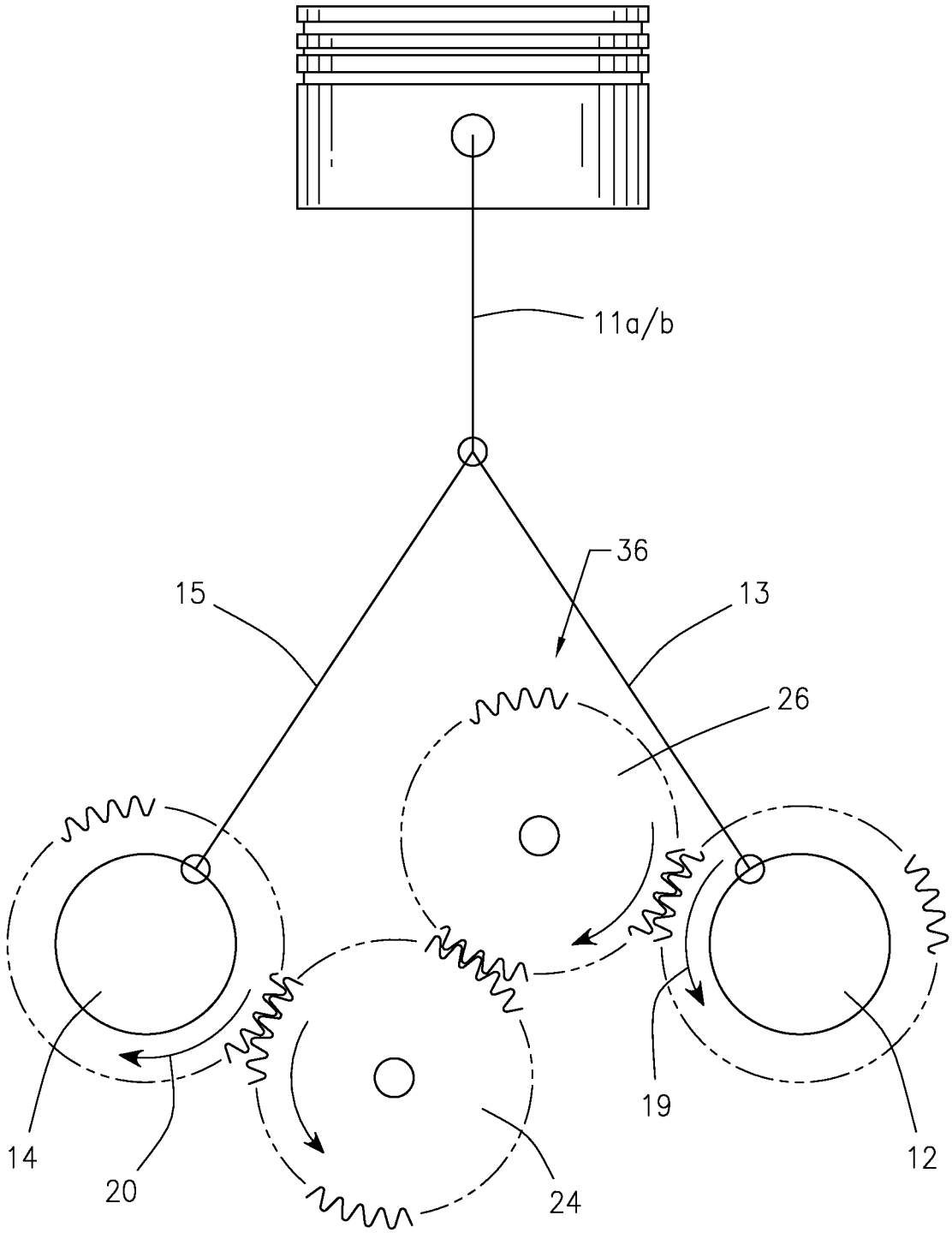
FIG. 2 is a schematic view of an example of a gear arrangement in accordance with an illustrative embodiment of the dual crankshaft internal combustion engine disclosed herein.

Referring now to FIG. 2, the dual crankshaft internal combustion engine 10 may include at least one linkage gear 36, such as an output shaft 24 and a power shaft 26 intermediate of the crankshafts 12 and 14 for a power transmission. The output shaft 24 and the power shaft 26 are geared together and geared with the crankshafts 12 and 14, such that the rotational motion of the crankshafts 12 and 14 is transferred to the output shaft 24 and the power shaft 26. Further, the output shaft 24 and the power shaft 26 may be staggered, such as with the power shaft 26 occupying an upper position and the output shaft occupying a lower position. It will be appreciated that this arrangement may be reversed, such that the power shaft 26 occupies the lower position and the output shaft occupies the upper position. Either arrangement allows the power shaft 26 and the output shaft 24 to be retrofitted to existing internal combustion engines, and also provides sufficient space to accommodate a ring gear (not shown) for a starter assembly (not shown). The size of the gears of the crankshafts 12 and 14 may be adjusted in order to be adapted to fit the existing gears of the power shaft 26 and/or the output shaft 24 for existing transmissions.

Figure 3:
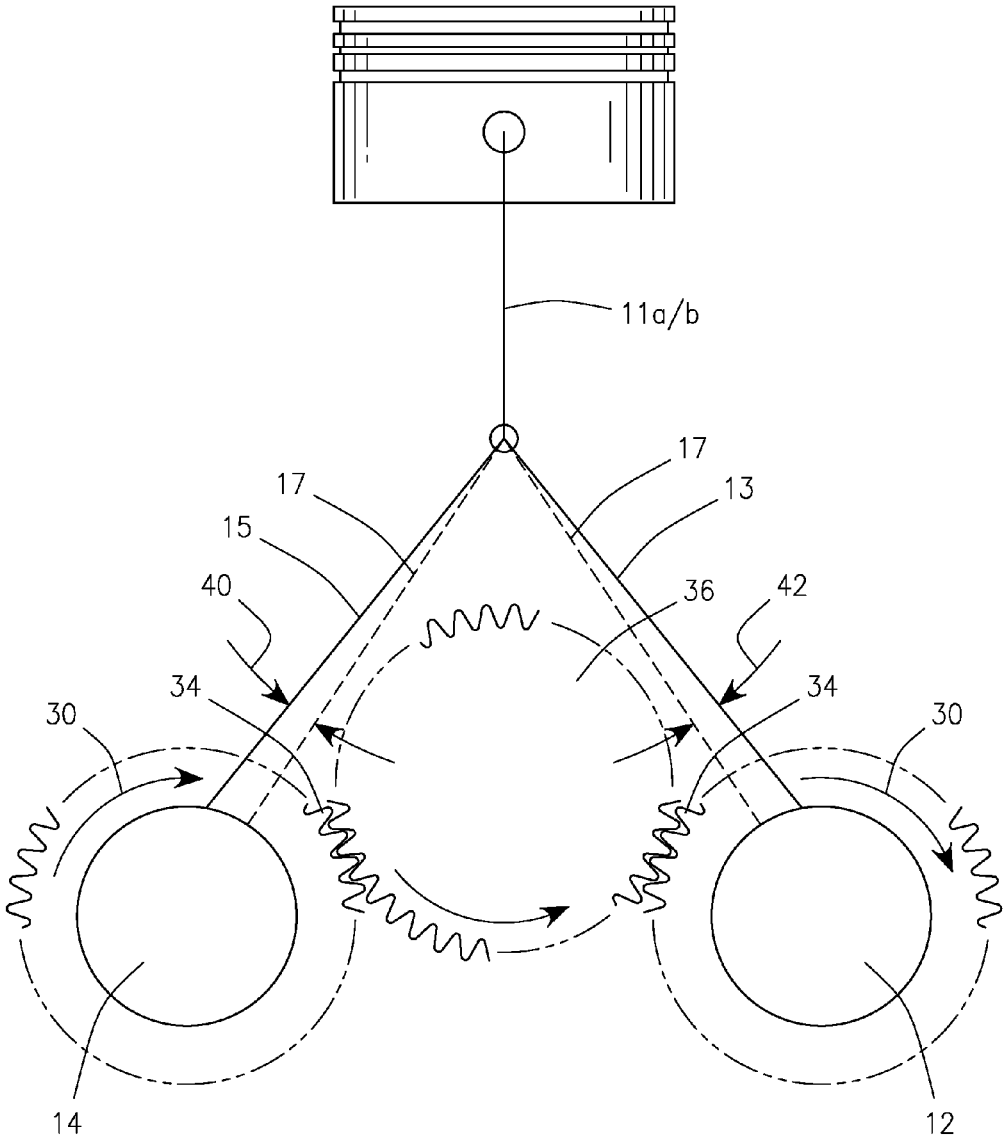
FIG. 3 is a schematic view of another example of a gear arrangement in accordance with an illustrative embodiment of the dual crankshaft internal combustion engine disclosed herein.
Figure 5:
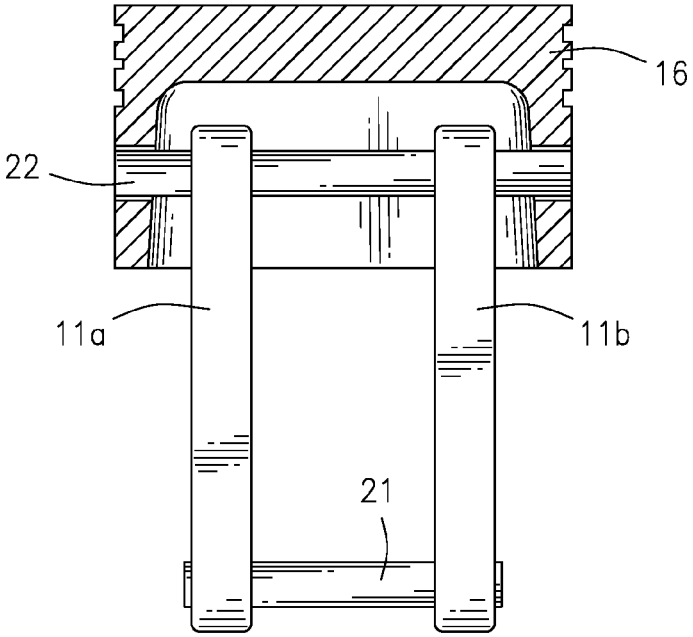
FIG. 5 is a side, partial cutaway view of piston rods secured to a piston in accordance with an illustrative embodiment of the dual crankshaft internal combustion engine disclosed herein.
Figure 6:
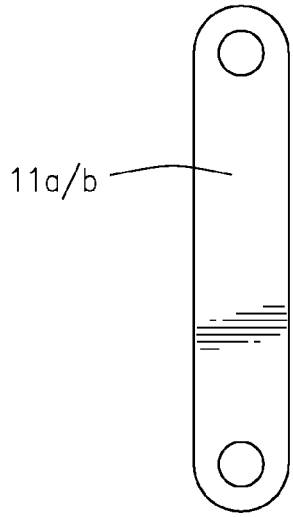
FIG. 6 is a side perspective view of an example of a piston rod in accordance with an illustrative embodiment of the dual crankshaft internal combustion engine disclosed herein.
Figure 4:
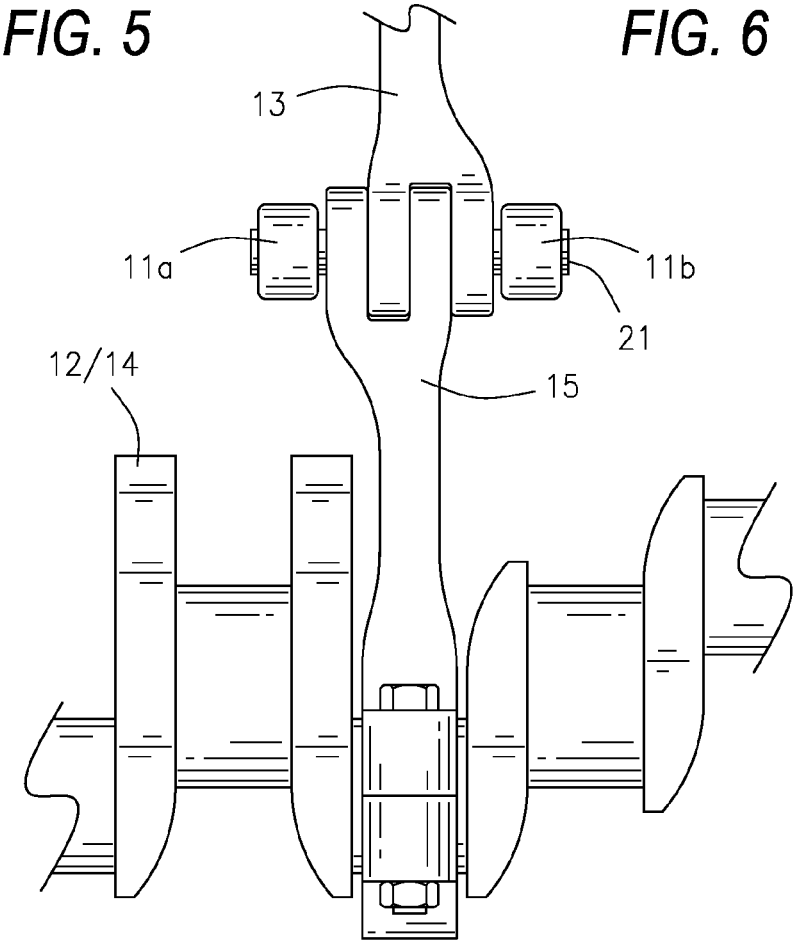
FIG. 4 is a side, partial cutaway view of connecting rods secured to a crankshaft in accordance with an illustrative embodiment of the dual crankshaft internal combustion engine disclosed herein.

Alternatively as exemplified in FIG. 3, the dual crankshaft internal combustion engine 10 may include the linkage gear 36 disposed intermediate of the crankshafts 12 and 14, causing the crankshafts 12 and 14 to rotate in the same direction, as shown by directional arrows 30. The linkage gear 36 serves to synchronize the rotation of the crankshafts 12 and 14, thereby allowing crankshafts 12 and 14 to rotate in the same direction, either clockwise or counterclockwise.

The dual crankshaft internal combustion engine 10 may further incorporate additional piston rods rotatably connected to gears or crankshafts 12 and 14. One of the additional piston rods may be rotatably or pivotally connected to an orbital (not shown), while the other piston rod may be rotatably or pivotally connected to an air supply (not shown), thus allowing the dual crankshaft internal combustion engine 10 to be supercharged, even at idle. The additional piston rods may be connected via a journal (not shown).

Figure 7:
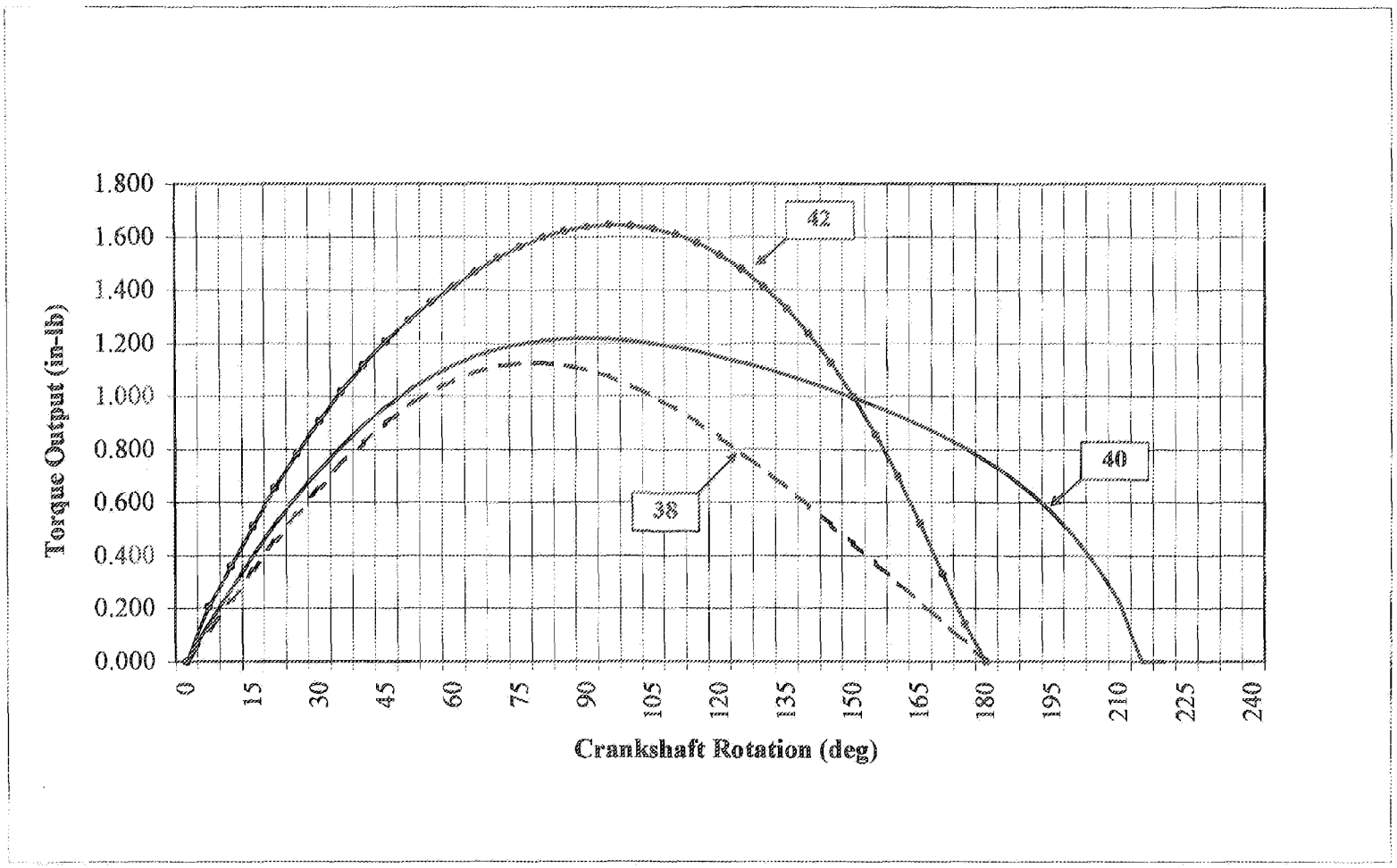
FIG. 7 is a graphical representation of a comparison of the torque output and crankshaft rotation between the dual crankshaft internal combustion engine disclosed herein and a conventional engine.

FIG. 7 graphically illustrates the mechanical advantage relationship of the dual crankshaft internal combustion engine 10 over a conventional engine. Line curve 38 represents a conventional engine, line curve 40 represents the dual crankshaft internal combustion engine 10 having a counter-rotating crankshaft configuration (FIG. 2), and line curve 42 represents the dual crankshaft internal combustion engine 10 having a same direction rotating crankshaft configuration (FIG. 3).

As illustrated in FIG. 7, one of the advantages of the dual crankshaft internal combustion engine 10 illustrated in FIG. 2 having counter-rotating crankshafts 12 and 14 is that the power stroke is increased to approximately two-hundred and fifteen degrees) (215°) of the corresponding crankshaft rotation from one-hundred and eighty degrees) (180°) of the crankshaft rotation in a conventional internal combustion engine. In addition, the angle at which the connecting rods 13 and 15 are attached to the crankshafts 12 and 14 in the dual crankshaft internal combustion engine 10 serves to develop increased rotational torque. Thus, the design of the crankshafts 12 and 14 being vertically offset from the piston 16 in the dual crankshaft internal combustion engine 10 causes an increased power stroke and torque from the additional leverage or wedge-effect. This wedge-effect increases the torque and duration to the crankshafts 12 and 14 over a conventional internal combustion engine, as illustrated by line curve 40 of the graph of FIG. 7, when the total angle between the connecting rods 13 and 15 of the dual crankshaft internal combustion engine 10 is approximately ninety degrees) (90°). As illustrated, the torque output of a convention engine is approximately 1.1 in/lb with a total work output of approximately 126, whereas the torque output of the dual crankshaft internal combustion engine 10 illustrated in FIGS. 1 and 2 is approximately 1.2 in/lb with a total work output of approximately 187. This enhancement is furthered by the fact that conventional engines begin to exhaust the combustion chamber at approximately one-hundred and fifty degrees) (150°), whereas the dual crankshaft internal combustion engine 10 may delay in exhausting the combustion chamber to approximately two-hundred degrees) (200°) from top dead center 17. The dual crankshaft internal combustion engine 10 eliminates the need for a flywheel in a four-cylinder engine because of the power overlap of approximately twenty degrees) (20°) on every power stroke, and thus, the dual crankshaft internal combustion engine 10 does not coast during operation because there is no power lag between power strokes. In this counter-rotating configuration, by closing the intake valve of the dual crankshaft internal combustion engine 10 at approximately 140 degrees to maintain 10-1 compression ratio results in an at least 15-1 expansion ratio.

Another of the advantages as graphically illustrated in FIG. 7, when the dual crankshaft internal combustion engine 10 is configured to have the crankshafts 12 and 14 rotating in the same direction, as illustrated in FIG. 3, the power and intake stroke remains one-hundred and eighty degrees) (180°) of the crankshaft rotation similar to a conventional internal combustion engine, but the torque output of the dual crankshaft internal combustion engine 10 increases from approximately 1.1 in/lb to approximately 1.6 in/lb (for 1 lb of input). Further the total work output by the dual crankshaft internal combustion engine 10 have the crankshafts 12 and 14 rotating in the same direction would be approximately 200, an increase from approximately 126 for a conventional engine. In this same directional rotating configuration, by closing the intake valve of the dual crankshaft internal combustion engine 10 at approximately 110 degrees to maintain 10-1 compression ratio results in an at least 15-1 expansion ratio.

Further as can be seen from FIG. 3, the crankshafts 12 and 14 of the dual crankshaft combustion engine 10 may include a lag 40, 42 of up to approximately twenty degrees) (20°), and preferably from approximately ten degrees) (10°) to approximately fifteen degrees) (15°) of total lag between the crankshafts 12 and 14. The dwell angle 40 before top dead center 17 of crankshaft 12 and/or the dwell angle 42 after top dead center 17 of crankshaft 14 will cause the piston 16 to pause for the duration of the lag 40, 42 at top dead center 17 allowing less spark advance, which will reduce back pressure on the piston 16. For example, when the lag 40, 42 is between the crankshafts 12 and 14 is approximately 15 degrees and the crankshafts 12 and 14 are configured to rotate in a clockwise direction as illustrated in FIG. 3, then crankshaft 14 will lag 40 rotating with the crankshaft 12 until crankshaft 14 has rotated by approximately 7.5 degrees. The same would be true if the dual crankshaft internal combustion engine 10 is configured to rotate counterclockwise, in which case crankshaft 12 will lag crankshaft 14. This lag 40, 42 is exemplified in FIG. 7 between 0 degrees and 15 degrees of crankshaft rotation.

The dual crankshaft internal combustion engine 10 works with all types of internal combustion engines, including but not limited to, two-stroke, four-stroke, V-6, V-8, diesel, inline and/or opposed-piston engines. In addition, the benefits and advantages of the dual crankshaft internal combustion engine 10 may be incorporated and utilized with other developing technologies, such as those that improve fuel efficiency by modifying the combustion chambers in a convention engine, to provide for a more efficient and powerful engine.

Whereas, the devices and methods have been described in relation to the drawings and claims, it should be understood that other and further modifications, apart from those shown or suggested herein, may be made within the spirit and scope of this invention.

What is claimed is:

1. A dual crankshaft internal combustion engine, comprising:

a first crankshaft and a second crankshaft in a spaced relation and having parallel rotary axes, said first crankshaft and said second crankshaft each having a spur gear for rotation about said rotary axis of said crankshaft, said spur gears of said first crankshaft and said second crankshaft having the same diameter and the same number of teeth, causing said first crankshaft and said second crankshaft to rotate at the same speed and in the same or opposite directions;

at least one linkage gear disposed intermediate of said first crankshaft and said second crankshaft, said linkage gear engaged with said spur gear of said first crankshaft and said spur gear of said second crankshaft;

at least one cylinder having a head at an upper end and a crank case at a lower end;

at least one piston within said cylinder, said piston cyclically reciprocates within said cylinder between a top dead center position and a bottom dead center position, said first crankshaft and said second crankshaft being vertically offset from said piston; and a first connecting rod and a second connecting rod pivotally attached to a first piston rod and a second piston rod via a connecting rod pin, said first piston rod and said second piston rod connected to said piston via a piston pin, said first piston rod and said second piston rod located an equidistance between said first crankshaft and said second crankshaft;

wherein said second crankshaft rotationally lags said first crankshaft;

wherein said first crankshaft has a dwell angle of approximately 7.5 degrees before said top dead center position of said piston;

wherein said second crankshaft has a dwell angle of approximately 7.5 degrees after said top dead center position of said piston.

2. The dual crankshaft internal combustion engine of claim 1 wherein said first crankshaft and said second crankshaft rotate in the same direction.

3. The dual crankshaft internal combustion engine of claim 2 wherein said spur gear of said first crankshaft rotates in a clockwise direction.

4. The dual crankshaft internal combustion engine of claim 2 wherein an intake valve is closed at approximately 110 degrees to maintain a 10-1 compression ratio resulting in an at least 15-1 expansion ratio.

5. The dual crankshaft internal combustion engine of claim 2 wherein an intake valve is closed at approximately 180 degrees to provide a super-charge effect to said dual crankshaft internal combustion engine.

6. The dual crankshaft internal combustion engine of claim 1 wherein said linkage gear further comprises an output shaft and a power shaft intermediate of said first crankshaft and said second crankshaft for a power transmission, and where said output shaft and said power shaft are geared together and geared with said first crankshaft and said second crankshaft, such that the rotational motion of said first crankshaft and said second crankshaft is transferred to said output shaft and said power shaft.

7. The dual crankshaft internal combustion engine of claim 6 wherein said output shaft and said power shaft staggered and wherein said first crankshaft and said second crankshaft counter-rotate in opposite directions.

8. The dual crankshaft internal combustion engine of claim 7 wherein said spur gear of said first crankshaft rotates in a counterclockwise direction.

9. The dual crankshaft internal combustion engine of claim 7 wherein a power stroke of said dual crankshaft internal combustion engine is approximately 215 degrees.

10. The dual crankshaft internal combustion engine of claim 9 wherein an intake valve is closed at approximately 215 degrees to provide a super-charge effect to said dual crankshaft internal combustion engine.

11. The dual crankshaft internal combustion engine of claim 7 wherein an intake valve is closed at approximately 140 degrees to maintain a 10-1 compression ratio resulting in an at least 15-1 expansion ratio.

12. A dual, unidirectional rotating crankshaft internal combustion engine, comprising:

a first crankshaft and a second crankshaft in a spaced relation and having parallel rotary axes, said first crankshaft and said second crankshaft each having a spur gear for rotation about said rotary axis of said crankshaft, said spur gear of said first crankshaft and said second crankshaft having an equal diameter and an equal number of teeth, causing said first crankshaft and said second crankshaft to rotate at equal speeds and in a same direction;

an odd number of linkage gears disposed intermediate of said first crankshaft and said second crankshaft, said linkage gears engaged with said spur gear of said first crankshaft and said spur gear of said second crankshaft;

at least one cylinder having a head at an upper end and a crank case at a lower end;

at least one piston within said cylinder, said piston cyclically reciprocates within said cylinder between a top dead center position and a bottom dead center position, said first crankshaft and said second crankshaft being vertically offset from said piston; and a first connecting rod and a second connecting rod pivotally attached to a piston rod via a connecting rod pin, said piston rod connected to said piston via a piston pin, said piston rod located an equidistance between said first crankshaft and said second crankshaft;

wherein said first crankshaft rotationally lags said second crankshaft or said second crankshaft rotationally lags said first crankshaft by approximately 10 degrees to approximately 20 degrees until both said first crankshaft and said second crankshaft rotate past said top dead center position;

wherein said first crankshaft has a dwell angle of between approximately 5 degrees and approximately 10 degrees before said top dead center position of said piston;

wherein said second crankshaft has a dwell angle of between approximately 5 and approximately 10 degrees after said top dead center position of said piston.

13. The dual crankshaft internal combustion engine of claim 12 wherein said spur gear of said first crankshaft rotates in a clockwise direction.

14. The dual crankshaft internal combustion engine of claim 12 wherein an intake valve is closed at approximately 110 degrees to maintain a 10-1 compression ratio resulting in an at least 15-1 expansion ratio.

15. The dual crankshaft internal combustion engine of claim 12 wherein said rotational lag of said first crankshaft and said second crankshaft is approximately 15 degrees.

16. The dual crankshaft internal combustion engine of claim 12 wherein said dwell angle of said first crankshaft is approximately 7.5 degrees before said top dead center position of said piston, and wherein said dwell angle of said second crankshaft is approximately 7.5 degrees after said top dead center position of said piston.

17. A dual, counter-rotating crankshaft internal combustion engine, comprising:

a first crankshaft and a second crankshaft in a spaced relation and having parallel rotary axes, said first crankshaft and said second crankshaft each having a spur gear for rotation about said rotary axis of said crankshaft, said spur gears of said first crankshaft and said second crankshaft having an equal diameter and an equal number of teeth, causing said first crankshaft and said second crankshaft to rotate at an equal speed and in opposite directions;

an even number of linkage gears disposed intermediate of said first crankshaft and said second crankshaft, said linkage gears engaged with said spur gear of said first crankshaft and said spur gear of said second crankshaft, said linkage gears comprising an output shaft and a power shaft intermediate of said first crankshaft and said second crankshaft, said output shaft and said power shaft being geared together and geared with said first crankshaft and said second crankshaft, such that the rotational motion of said first crankshaft and said second crankshaft is transferred to said output shaft and said power shaft;

at least one cylinder having a head at an upper end and a crank case at a lower end;

at least one piston within said cylinder, said piston cyclically reciprocates within said cylinder between a top dead center position and a bottom dead center position, said first crankshaft and said second crankshaft being vertically offset from said piston; and a first connecting rod and a second connecting rod pivotally attached to a piston rod via a connecting rod pin, said piston rod connected to said piston via a piston pin, said piston rod located an equidistance between said first crankshaft and said second crankshaft;

wherein a power stroke of said dual crankshaft internal combustion engine is approximately 215 degrees;

wherein said first crankshaft rotationally lags said second crankshaft or said second crankshaft rotationally lags said first crankshaft by approximately 10 degrees to approximately 20 degrees until both said first crankshaft and said second crankshaft rotate past said top dead center position;

wherein said first crankshaft has a dwell angle of between approximately 5 degrees and approximately 10 degrees before said top dead center position of said piston;

wherein said second crankshaft has a dwell angle of between approximately 5 and approximately 10 degrees after said top dead center position of said piston.

18. The dual crankshaft internal combustion engine of claim 17 wherein said output shaft and said power shaft staggered and wherein said spur gear of said first crankshaft rotates in a counterclockwise direction.

19. The dual crankshaft internal combustion engine of claim 17 wherein an intake valve is closed at approximately 140 degrees to maintain a 10-1 compression ratio resulting in an at least 15-1 expansion ratio.

20. The dual crankshaft internal combustion engine of claim 17 wherein said dwell angle of said first crankshaft is approximately 7.5 degrees before said top dead center position of said piston, and wherein said dwell angle of said second crankshaft is approximately 7.5 degrees after said top dead center position of said piston.

* * * * *